United States Patent [19]

Nakai et al.

[11] Patent Number: 4,758,108

[45] Date of Patent: Jul. 19, 1988

[54] PRINTING APPARATUS WITH CARRIAGE DRIVE UTILIZED TO FEED PRINT AND ERASE RIBBONS AND/OR TO FEED THE PRINT RIBBON AND SHIFT THE ERASE RIBBON

[75] Inventors: Toshio Nakai, Nagoya; Osamu Nagata, Aichi; Kenji Sakakibara, Ichinomiya; Michitoshi Akao, Nagoya; Shigeyuki Hayashi, Nagoya; Toshio Takahashi, Nagoya; Hidetoshi Asada, Nagoya, all of Japan

[73] Assignee: Brother Kogyo Kabushiki Kaisha, Aichi, Japan

[21] Appl. No.: 911,133

[22] Filed: Sep. 24, 1986

[30] Foreign Application Priority Data

Sep. 26, 1985 [JP] Japan ..... 60-213458
Mar. 4, 1986 [JP] Japan ..... 61-46990

[51] Int. Cl.[4] ..... B41J 29/36; B41J 31/09

[52] U.S. Cl. ..... 400/697.1; 400/225; 400/229; 400/216.2

[58] Field of Search ..... 400/697, 697.1, 225, 400/229, 231, 233, 240.1, 211, 212, 216.2, 216.3

[56] References Cited

U.S. PATENT DOCUMENTS

| | | | |
|---|---|---|---|
| 3,841,459 | 10/1974 | Buschmann | 400/229 X |
| 3,939,957 | 2/1976 | Bittner | 400/229 X |
| 3,995,731 | 12/1976 | Miller | 400/229 X |
| 4,422,786 | 12/1983 | Piptone | 400/229 |
| 4,440,514 | 4/1984 | Keiter | 400/697.1 X |
| 4,460,287 | 7/1984 | Theilen et al. | 400/213.1 |
| 4,498,792 | 2/1985 | Falconieri | 400/229 X |
| 4,531,849 | 7/1985 | Dobashi | 400/229 |
| 4,596,480 | 6/1986 | Takada | 400/229 |
| 4,609,297 | 9/1986 | Hubner | 400/697.1 X |
| 4,637,744 | 1/1987 | Valle | 400/697.1 X |

FOREIGN PATENT DOCUMENTS

| | | | |
|---|---|---|---|
| 287750 | 2/1971 | Australia | 400/229 |
| 0075084 | 3/1983 | European Pat. Off. | 400/229 |
| 2550285 | 5/1976 | Fed. Rep. of Germany | 400/229 |
| 3210723 | 10/1983 | Fed. Rep. of Germany | 400/213.1 |
| 62-71691 | 4/1987 | Japan | 400/697.1 |
| 1139060 | 1/1969 | United Kingdom | 400/229 |
| 1493479 | 11/1977 | United Kingdom | 400/229 |

*Primary Examiner*—Paul T. Sewell
*Attorney, Agent, or Firm*—Parkhurst & Oliff

[57] ABSTRACT

A printer, including a first and a second feed mechanism supported by a carriage for feeding a print ribbon and an erase ribbon, respectively, at least one rotatable shaft supported by the reciprocating carriage rotatably in opposite directions, a one-way clutch for transmitting the shaft rotation in one of the opposite directions to the first feed mechanism, and inhibiting transmission of the rotation in the other direction, and a control mechanism for inhibiting transmission of the shaft rotation to the second feed mechanism when the printer is in a printing mode, and transmitting the shaft rotation to the second ribbon mechanism when the printer is in a correction mode, whereby the carriage reciprocation activates the first and second feed mechanisms. A converter may be provided for converting the shaft rotation into movements of a ribbon lift to shift the erase ribbon between an erasing and an inoperative position. The rotation control mechanism inhibits transmission of the shaft rotation to the converter while in the printing mode, but transmits the rotation to the converter while in the correction mode. Thus, the carriage reciprocation also cause the shifting movements of the erase ribbon.

11 Claims, 10 Drawing Sheets

PRINTING APPARATUS WITH CARRIAGE DRIVE UTILIZED TO FEED PRINT AND ERASE RIBBONS AND/OR TO FEED THE PRINT RIBBON AND SHIFT THE ERASE RIBBON

BACKGROUND OF THE INVENTION

1. Field of the Invention

The present invention relates generally to improvements in a printing apparatus having a carriage which carries a print-erase head, a print ribbon and an erase ribbon and which is moved along a platen. More particularly, the invention is concerned with improvements to minimize the size and weight of the mechanisms supported on the carriage.

2. Discussion of the Related Art

Some of the known printers such a typewriters are equipped with a carriage which is reciprocable in a longitudinal direction of a platen. The carriage is adapted to support a mechanism to feed a print ribbon, a mechanism to feed an erase or correction ribbon, a print/erase head, and other devices, and is reciprocated by a drive source such as an electric motor. The ribbon feed mechanisms are required to be activated at suitable times. It is desirable to shift the active portion of the print ribbon between a rest or inoperative position, and a printing or operative position between the platen and the print/erase head. However, this shifting of the print ribbon is not essential. On the other hand, it is essential that the active portion of the erase ribbon be shifted between its rest and erasing positions. In the case where the print ribbon is not adapted to be elevated and lowered between its printing and rest positions, a character printed on the recording medium is erased while the active portion of the erase ribbon is located between the print ribbon and the platen (recording medium). More specifically, the print/erase head is activated to impact the appropriate type font against the recording medium via the print and erase ribbons, so that the character is erased by the impacted area of the erase ribbon. In the case where the print ribbon is adapted to be shifted between its printing and rest positions, the erasure of a character is effected with the print ribbon moved to its rest position and with the erase ribbon moved to its erasing position. In this case, the print/erase head is activated to impact the appropriate type font against the recording medium via the erase ribbon only.

As is apparent from the foregoing description, it is required that the print ribbon feed mechanism, the erase ribbon feed mechanism, the erase ribbon lift mechanism, and other devices, be operated while they are supported on the carriage. If the above three mechanisms associated with the print and erase ribbons are operated by three exclusive drive devices, the corresponding three separate or independent drive sources are necessary. The mounting of these three drive sources on the carriage will not only increase the cost of the printer, but also increase the mass of an assembly of the carriage and the devices mounted on the carriage, thereby making it difficult to feed the carriage assembly at a high rate for increased printing efficiency.

A known solution to the above drawback utilized reciprocating movements of the carriage by the carriage drive motor, for feeding the print ribbon, for example. In this instance, a shaft is rotatably supported on the carriage so that the shaft is rotated by means of its movement relative to the printer frame when the carriage is reciprocated. The rotating movement of the shaft is transmitted to the print ribbon feed mechanism, to feed the print ribbon. Generally, this arrangement uses a one-way clutch which permits transmission of the rotation of the shaft in one of opposite directions to the print ribbon feed mechanism, but inhibits transmission of the shaft rotation in the other direction.

Although it is considered possible to utilize the carriage drive source to feed the erase ribbon and shift its active portion in the same manner as mentioned above, there have been no attempts to utilize the carriage drive source for feeding both of the print and erase ribbons, and/or for feeding the print ribbon and shifting the erase ribbons. While the printer is in a normal printing mode, the feeding of the print ribbon is required, but the feeding and shifting of the erase ribbon are unnecessary. In a correction mode for erasure or correction of characters, on the contrary, the feeding of the print ribbon is not required while the feeding and shifting of the erase ribbon are necessary. Thus, the print ribbon feed mechanism, and the erase ribbon feed or shifting mechanism require a drive force at different times. For this reason, it has been considered difficult to obtain a particularly satisfactory arrangement in which the above two mechanisms are operated by the carriage drive source.

SUMMARY OF THE INVENTION

It is therefore a primary object of the present invention to provide a printing apparatus wherein the drive source for reciprocating the carriage is utilized for operating at least one of the erase ribbon feed and shifting mechanisms, and the print ribbon feed mechanism.

Another object of the invention is the provision of such a printing apparatus which is simplified in construction to a maximum possible extent.

A further object of the invention is to provide a printing apparatus wherein the feeding of the print ribbon, and the feeding and/or shifting of the erase ribbon are effected by minimum distances of simple reciprocating movements of the carriage by the carriage drive source.

According to the invention, there is provided a printing apparatus, comprising: a platen for supporting a recording medium; a carriage reciprocable in a longitudinal direction of the platen; a carriage drive device for reciprocating the carriage; a first and a second ribbon feed mechanism supported by the carriage, for feeding a print ribbon and an erase ribbon at a predetermined pitch, respectively; a print/erase head supported by the carriage, for printing a character on the recording medium via the print ribbon, and erasing a chracter on the medium via the erase ribbon; a first and a second rotatable shaft; a first one-way clutch; an erase-ribbon lift; a converter mechanism; and a rotation control mechanism.

The first and a second rotatable shaft are supported by the carriage rotatably in opposite directions when the carriage is moved in corresponding opposite directions. The first one-way clutch is adapted to transmit a rotating movement of the first rotatable shaft in one of the opposite directions, to the first ribbon feed mechanism, and to inhibit transmission of a rotating movement of the first rotatable shaft in the other direction to the first ribbon feed mechanism. The erase-ribbon lift member is operated to shift an active portion of the erase ribbon between an erasing position in which the active portion is located between the print/erase head and the recording medium, and an inoperative position in which the active portion is located away from the erasing position. The converter mechanism is adapted to convert a rotating movement of the second rotatable shaft into shifting movements of the erase-ribbon lift member to shift the active portion of the erase ribbon. The rotation control mechanism inhibits transmission of the rotating movement of the second rotatable shaft to the converter mechanism when the apparatus is in a normal printing mode, but transmits the rotating movement of the second rotatable shaft to the converter mechanism when the apparatus is in a correction mode.

In the printing apparatus of the invention constructed as described above, the reciprocating movements of the carriage cause not only the shifting movements of the erase-ribbon lift member, but also a feeding movement of the first ribbon feed mechanism to advance the print ribbon without the shifting movements of the erase-ribbon lift member. Thus, the apparatus eliminates independent drive devices for operating the print ribbon feed mechanism and the erase-ribbon lift member. Accordingly, the cost of the apparatus is reduced. Further, the size and weight of the assembly of the carriage and the devices mounted on the carriage is minimized, whereby the inertia of the carriage assembly is reduced. The reduced inertia of the carriage assembly means reduced capacity of the carriage drive device, and results in improved printing speed and enhanced positioning accuracy of the print/erase head.

According to one advantageous feature of the invention, the rotation control mechanism comprises a second one-way clutch for transmitting the rotating movement of the second rotatable shaft in one of the opposite directions, to the converter mechanism, and inhibiting transmission of the rotating movement of the second rotatable shaft in the other direction. The rotation control mechanism further comprises second disabling means for inhibiting the transmission of the rotating movement of the second rotatable shaft in the above-indicated one direction when the apparatus is in the normal printing mode.

In one form of the above feature of the invention, the second one-way clutch includes: a first coupling member engaging the second rotatable shaft rotatably relative to each other, and connected to the converter mechanism; a second coupling member engaging the second rotatable shaft rotatably relative to each other; and a spring wound on the second rotatable shaft so as to hold the second rotatable shaft, and having opposite ends which engage the first and second coupling members, respectively. In this case, the second disabling means includes: a detent member engageable with the second coupling member for inhibiting rotation of the second coupling member; and an actuator for moving the detent member between an engaging position in which the detent member engages the second coupling member, and a release position in which the detent member is disengaged from the second coupling member.

In an alternative form of the above feature of the invention, the apparatus further comprises a first disabling means for preventing the first one-way clutch from transmitting the rotating movement of the first rotatable shaft in the above-indicated one direction to the first ribbon feed mechanism. In this case, a common actuator may be used to selectively activate the first and second disabling means such that one of the first and second disabling means is in an operative position while the other disabling means is in an inoperative position.

According to another advantageous feature of the invention, the apparatus further comprises a linkage for transmitting the shifting movements of the erase-ribbon lift member to the second ribbon feed mechanicm to feed the erase ribbon. In this arrangement, the reciprocating movements of the carriage cause a feeding movement of the second ribbon feed mechanism, as well as the feeding movement of the first ribbon feed mechanism and the shifting movements of the erase-ribbon lift member, whereby the mass of the carriage assembly and the cost of the apparatus are further reduced.

In one form of the above advantageous feature of the invention, the linkage includes another one-way clutch for transmitting one of a lifting and a lowering movement of the erase-ribbon lift member to the second ribbon feed mechanism, and inhibiting transmission of the other of the lifting and lowering movements to the second ribbon feed mechanism.

In accordance with another aspect of the invention, there is provided a printing apparatus comprising: a platen for supporting a recording medium; a carriage reciprocable in a longitudinal direction of the platen; a carriage drive device for reciprocating the carriage; a first and a second ribbon feed mechanism supported by the carriage, for feeding a print ribbon and an erase ribbon at a predetermined pitch, respectively; a print/erase head supported by the carriage, for printing a character on the recording medium via the print ribbon, and erasing a character on the medium via the erase ribbon; a first and a second rotatable shaft supported by the carriage rotatably in opposite directions when the carriage is moved in corresponding opposite directions; a first one-way clutch and a rotation control mechanism.

The first one-way clutch is adapted to transmit a rotating movement of the first rotatable shaft in one of the opposite directions, to the first ribbon feed mechanism, and inhibit transmission of a rotating movement of the first rotatable shaft in the other direction to the first ribbon feed mechanism. The rotation control mechanism is adapted to inhibit transmission of the rotating movement of the second rotatable shaft to the second ribbon feed mechanism when the apparatus is in a normal printing mode, and transmitting the rotating movement of the second rotatable shaft to the second ribbon feed mechanism when the apparatus is in a correction mode.

In the above printing apparatus, the reciprocating movements of the carriage cause a feeding movement of the second ribbon feed mechanism to advance the erase ribbon, and a feeding movement of the first ribbon feed mechanism to advance the print ribbon with the feeding movement of the second ribbon feed mechanism. Thus, the same advantages as described above are provided.

According to a further aspect of the invention, there is provided a printing apparatus which comprises: a platen for supporting a recording medium; a carriage reciprocable in a longitudinal direction of the platen; a carriage drive device for reciprocating the carriage; a first and a second ribbon feed mechanism supported by the carriage, for feeding a print ribbon and an erase ribbon at a predeteremined pitch, respectively; a print/erase head supported by the carriage, for printing a character on the recording medium via the print ribbon, and erasing a character on the medium via the erase ribbon; a rotatable shaft supported by the carriage rotatably in opposite directions when the carriage is moved in corresponding opposite directions; a one-way clutch for transmitting a rotating movement of the rotatable shaft in one of the opposite directions, to the first ribbon feed mechanism, and inhibiting transmission of a rotating movement of the rotatable shaft in the other direction to the first ribbon feed mechanism; an erase-ribbon lift member for shifting an active portion of the erase ribbon between an erasing position in which the active portion is located between the print/erase head and the recording medium, and an inoperative position in which the active portion is located away from the erasing position; a converter mechanism; and a rotation control mechanism. The converter mechanism is adapted to convert a rotating movement of the rotatable shaft into shifting movements of the erase-ribbon lift member to shift the active portion of the erase ribbon. The rotation control mechanism is operated to inhibit transmission of the rotating movement of the rotatable shaft to the converter mechanism when the apparatus is in a normal printing mode, and transmit the rotating movement of the rotatable shaft to the converter mechanism when the apparatus is in a correction mode.

In the instant printing apparatus, too, the reciprocating movements of the carriage cause the shifting movements of the erase-ribbon lift member, and a feeding movement of the first ribbon feed mechanism to advance the print ribbon without the shifting movements of the erase-ribbon lift member. In this case, the apparatus may further comprises a linkage for transmitting the shifting movements of the erase-ribbon lift member to the second ribbon feed mechanism to feed the erase ribbon, whereby the reciprocating movements of the carriage cause a feeding movement of the second ribbon feed mechanism, as well as the feeding movement of the first ribbon feed mechanism and the shifting movements of the erase-ribbon lift member.

According to a further aspect of the invention, there is provided a printing apparatus, comprising: the carriage, the carriage drive device, the first and second ribbon feed mechanisms, the print/erase head, the rotatable shaft, and the one-way clutch, which have been described above. The apparatus further comprises a rotation control mechanism which is adapted to inhibit transmission of the rotating movement of the rotatable shaft to the second ribbon feed mechanism when the apparatus is in a normal printing mode, and transmit the rotating movement of the rotatable shaft to the second ribbon mechanism when the apparatus is in a correction mode. In this arrangement, the reciprocating movements of the carriage cause a feeding movement of the second ribbon feed mechanism to advance the erase ribbon, and a feeding movement of the first ribbon feed mechanism to advance the print ribbon without the feeding movement of the second ribbon feed mechanism.

BRIEF DESCRIPTION OF THE DRAWINGS

The above and optional objects, features and advantages of the present invention will be better understood by reading the following detailed description of preferred embodiments of the invention, when considered in connection with the accompanying drawings, in which.

DETAILED DESCRIPTION OF THE PREFERRED EMBODIMENTS

Referring to the accompanying drawings, the preferred embodiments of the invention will be described in detail.

Figure 1:
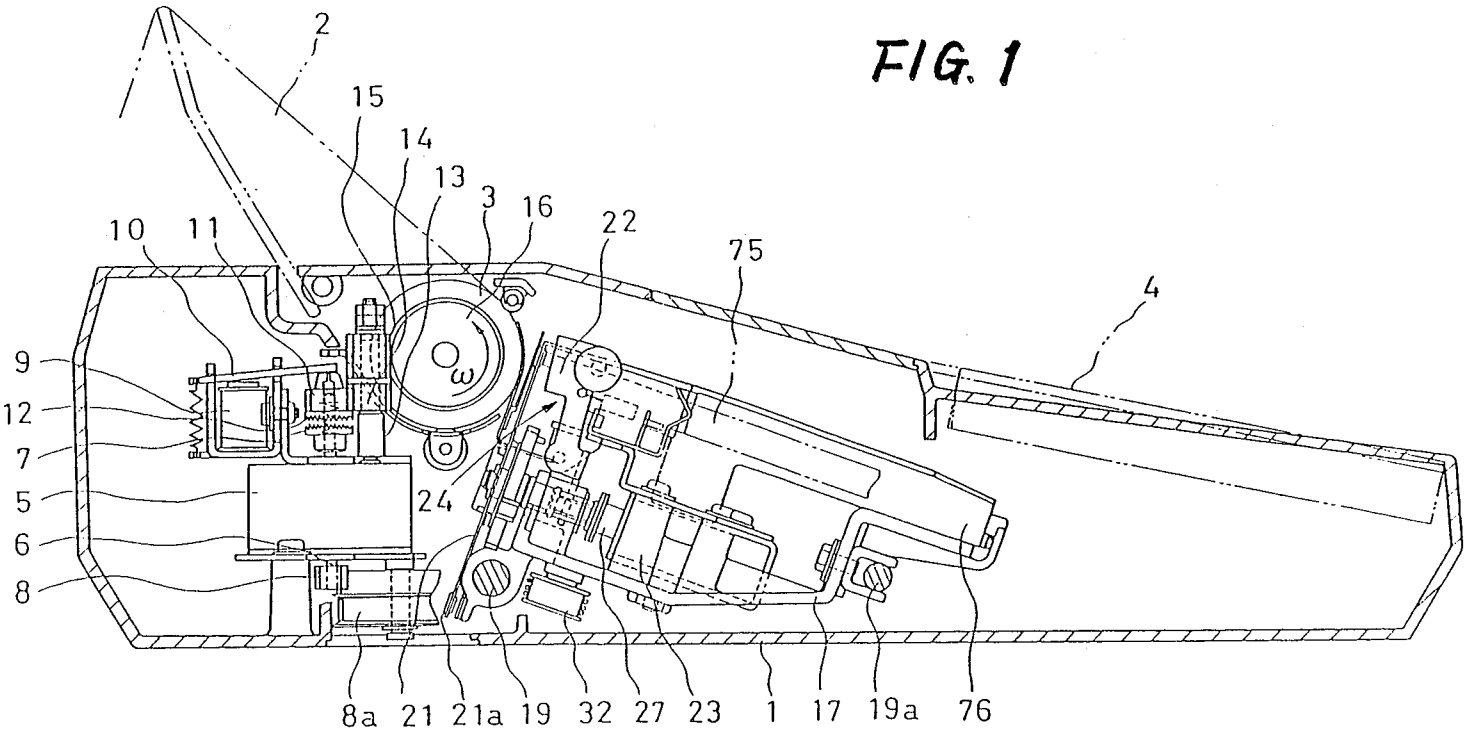
FIG. 1 is an elevational view in transverse cross section of one embodiment of a printing apparatus of the invention.

There is shown in FIG. 1 a printing apparatus in the form a typewriter having a casing 1 which is molded of a plastic material in a generally shallow box construction. In a rear portion of the casing 1, there is disposed a cylindrical platen 3 for supporting a recording medium in the form of a sheet of paper 2. A keyboard 4 is accommodated in a front portion of the casing 1. Below the platen 3, there is disposed a drive device in the form of a stepping motor 5 whose drive shaft 6 extends in opposite directions from its upper and lower surfaces, such that the shaft 6 is perpencidular to the axis of the platen 3. The drive shaft 6 has a lower annular sawtoothed member 7 fixed at its upper end, and a pinion 8 fixed at its lower end. The pinion 8 engages a pulley 8*a*. A solenoid 9 is secured to the upper surface of the stepping motor 5. The solenoid 9 has an armature 10 which is pivoted about its one end upon energization and deenergization of the solenoid 9. The armature 10 supports at its other end a spur gear 11 and an upper annular sawtoothed member 12 such that the gear 11 and the upper sawtoothed member 12 are rotatable about an axis parallel to the drive shaft 6 of the stepping motor 5. The lower and upper annular sawtoothed members 7 and 12 constitute a toothed clutch. Adjacent this toothed clutch, a support shaft 13 is disposed on the stepping motor 5, so as to extend parallel to the drive shaft 6. The support shaft 13 rotatably supports a pinion 14 engaging the spur gear 11 of the armature 10, and a worm 15 connected to the pinion 14. The worm 15 engages a worm wheel 16 secured to the platen 3. The worm 15 and the worm wheel 16 constitute a worm gearing unit.

When a carriage return key (not shown) provided on the keyboard 4 is activated, the stepping motor 5 is operated to rotate the pulley 8*a* via the drive shaft 6 and the pinion 8. The rotation of the pulley 8*a* is imparted to a carriage 17 (which will be described) through a wire (not shown) which is wound the pulley 8*a* and fixed to the carriage 17. Thus, the carriage 17 is returned to a printing start position near the left end of the platen 3. At the same time, the activation of the carriage return key temporarily energizes the solenoid 9, causing the armature to be pivoted in the downward direction, whereby the upper annular sawtoothed member 12 is brought into engagement with the lower annular sawtoothed member 7 fixed to the drive shaft 6. As a result, the worm 15 is rotated by a predetermined amount through the spur gear 11 and the pinion 14, and the worn wheel 16 engaging the worm 15 is accordingly rotated. In this manner, the platen 3 is rotated in a direction "w" indicated in FIG. 1, to advance the sheet of paper 2 by a predetermined line-to-line distance.

Figure 2:
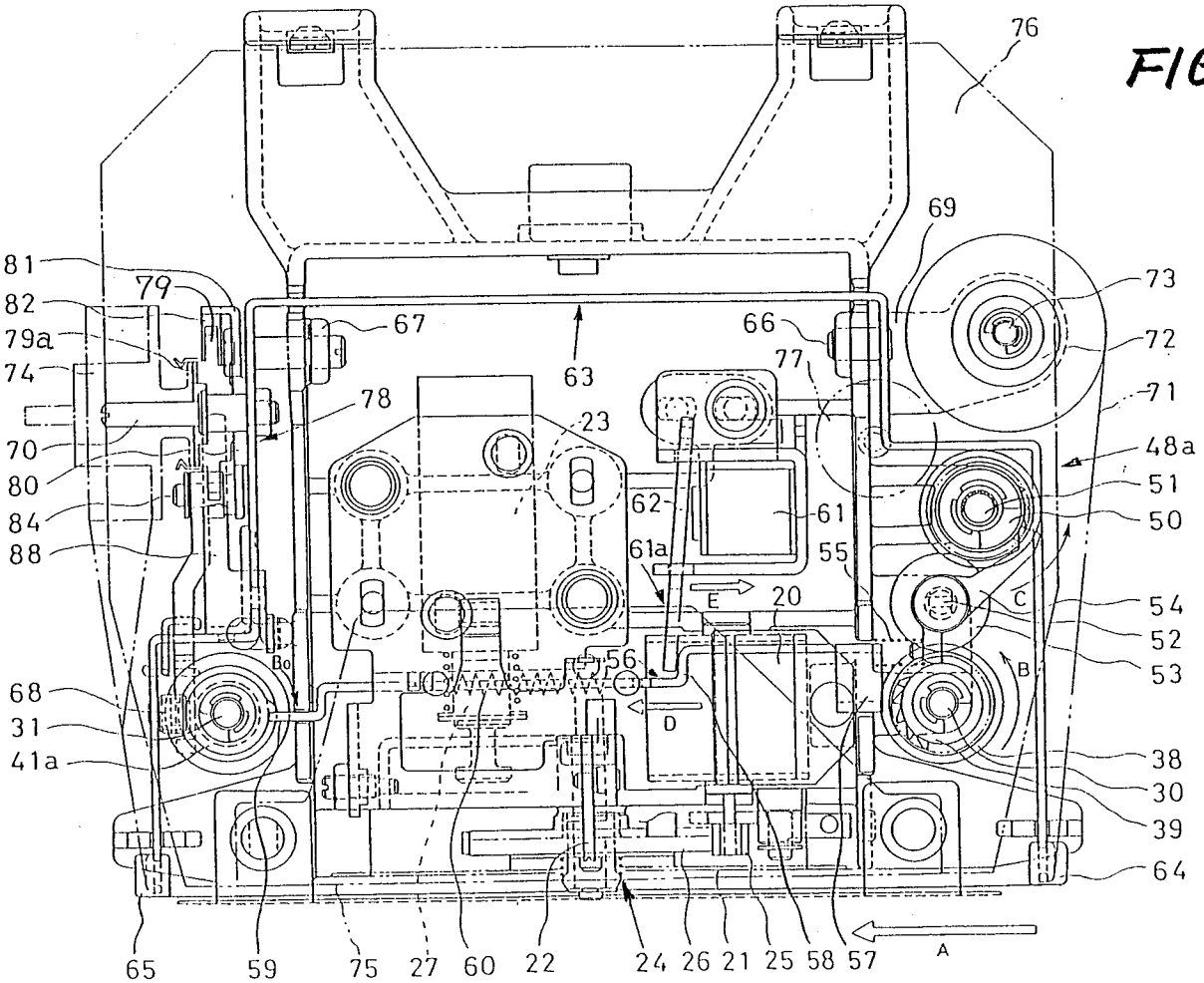
FIG. 2 is an enlarged plan view of a carriage assembly of the printing apparatus, with its ribbon cassette removed.

The carriage 17 is slidably supported by two spaced-apart guide rods 19, **19*a* which extend parallel to the platen 3, so that the carriage 17 is reciprocable in the longitudinal direction of the platen 3. As shown in FIG. 2, the carriage 17 has a print/erase head mounted thereon. The print/erase head includes a stepping motor 20, a type wheel 21, a hammer 22 and a solenoid 23. When a character key on the keyboard 4 is operated, the stepping motor 20 is operated by a suitable amount, to index the type wheel 21 to select the corresponding type font 21*a*, through a pinion 25 and a spur gear 26. Simultaneously, the solenoid 23 is energized to move an armature 27 so as to activate the hammer 22. Thus, the selected type font 21*a* is impacted by the hammer 22 against the paper 2 via a print ribbon 75** (which will be described).

Figure 3:
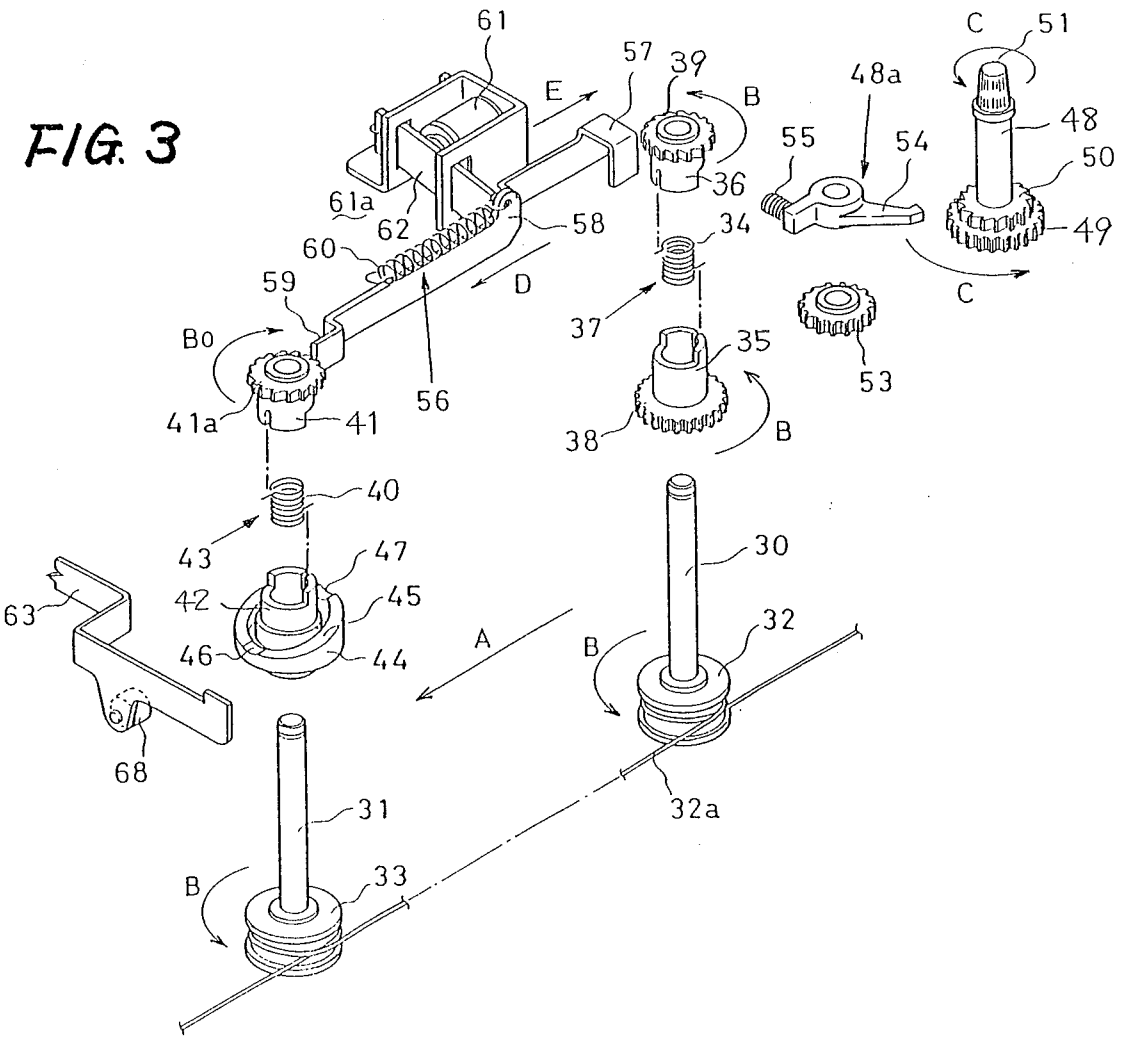
FIG. 3 is a perspective view of a portion of the carriage assembly.
Figure 4:
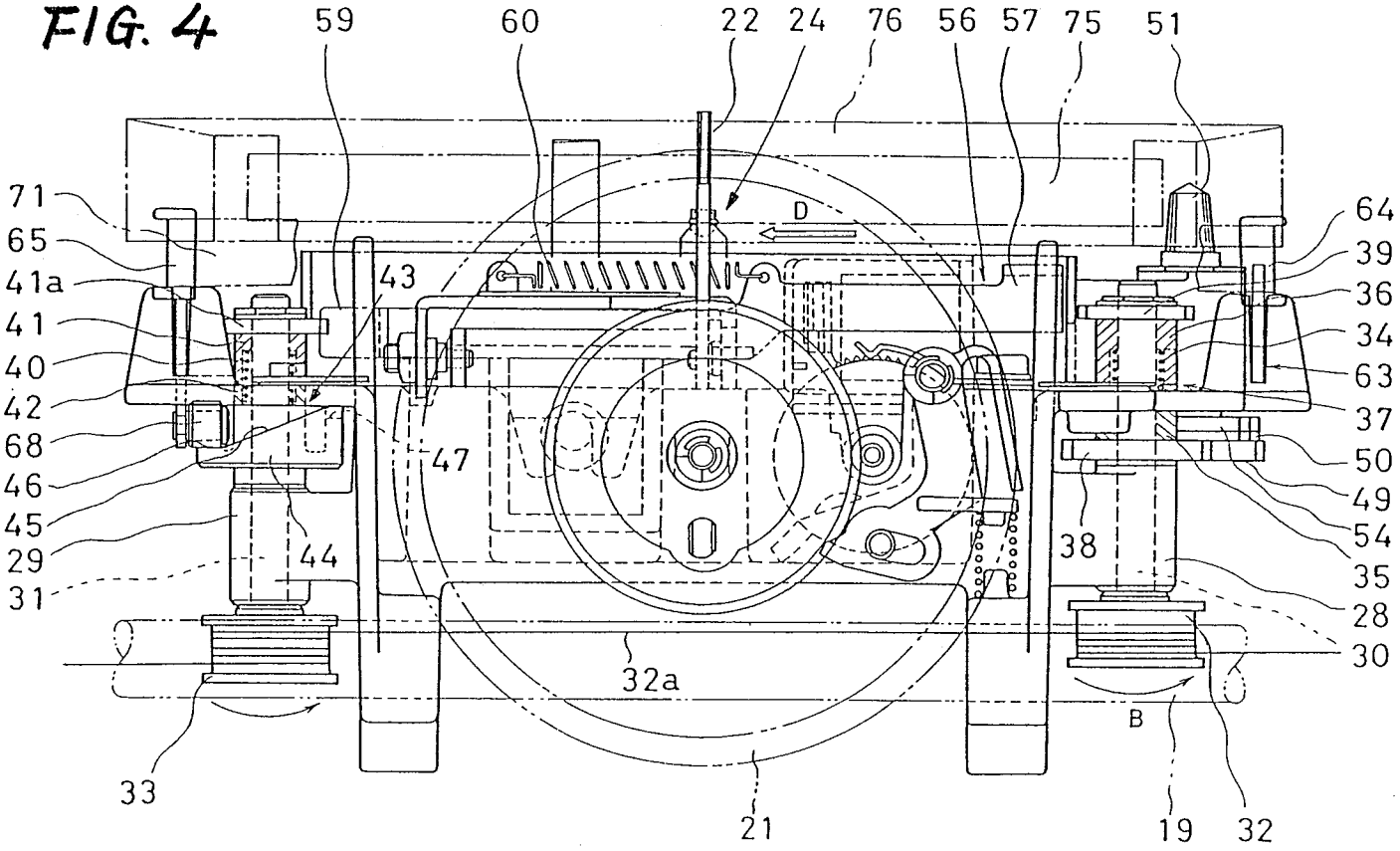
FIG. 4 is an enlarged front elevational view of the carriage assembly.
Figure 5:
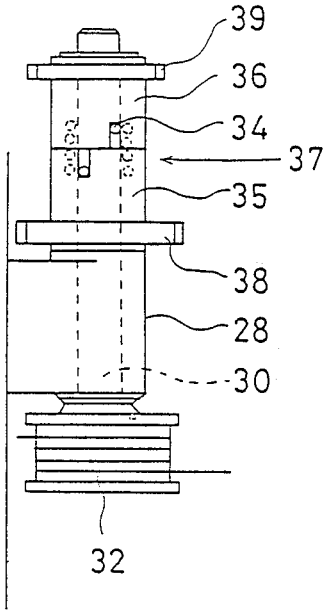
FIGS. 5 and 6 are elevational views showing spring clutches of a first and a second rotatable shaft supported on the carriage.

As shown in FIG. 4, the carriage 17 is formed with a pair of cylindrical support portions 28, 29 at its opposite ends, which are spaced apart from each other in the longitudinal direction of the platen 3. These cylindrical support portions 28, 29 have parallel vertical bores perpendicular to the platen 3. As also shown in FIG. 3, a corresponding pair of rotatable shafts, i.e., a first and a second rotatable shaft 30, 31 extend through the vertical bores of the support portions 28, 29, so that the rotatable shafts 30, 31 are rotatable relative to the support portions 28, 29, with their upper and lower portions located outside the bores. The rotatable shafts 30, 31 have respective first and second pulleys 32, 33 fixed to their lower ends. As indicated in FIG. 4, a string **32*a* is provided extending horizontally in a bottom portion of the casing 1. The string 32*a* is wound on the pulleys 32, 33 by a suitable number of turns, as also shown in FIG. 3. The opposite ends of the string 32*a* are fixed to the casing 1. When the carriage 17 is moved in a direction indicated at "A" in FIG. 3, namely, in the printing direction A, the pulleys 32, 33 are rotated by the string 32*a* wound thereon, in a direction indicated at "B". As shown in the perspective view of FIG. 3 and in the elevational view of FIG. 4 in detail, the first rotatable shaft 30 has a first one-way spring clutch 37 which consists of a coil spring 34 wound on a relatively upper part of the shaft 30, and two coupling members in the form of sleeves 35, 36 which are loosely fitted on the shaft 30, such that the coil spring 34 is positioned radially inwardly of the adjacent portions of the coupling sleeves 35, 36. The opposite ends of the coil spring 34 engage the corresponding coupling sleeves 35, 36. The lower coupling sleeve 35 is provided with a spur gear 38 fitted thereon, while the upper coupling sleeve 36 is provided with a ratchet wheel 39 fitted thereon. With the first pulley 32 and the first rotatable shaft 30 rotated in the direction "B", the coil spring 34 of the one-way spring clutch 37 is tightly wound on the first rotatable shaft 30 so as to grip the shaft, whereby the spur gear 38 and the ratchet wheel 39 are rotated in the direction "B", together with the coupling sleeves 35, 36. When the pulley 32 and the first rotatable shaft 30 are rotated in the direction opposite to the direction "B", the coil spring 30 will not be tightly wound on the first rotatable shaft 30, permitting the coupling sleeves 35, 36** to remain stationary.

Figure 6:
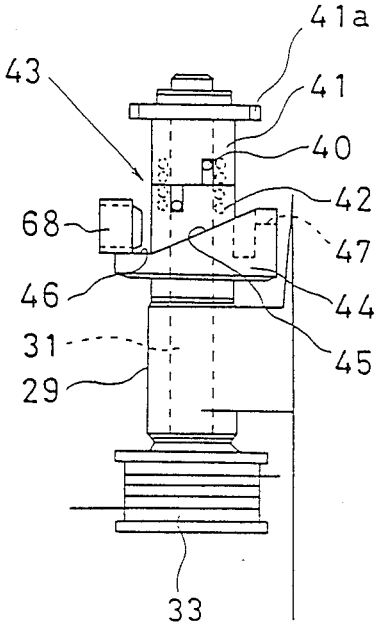
Figure 7:
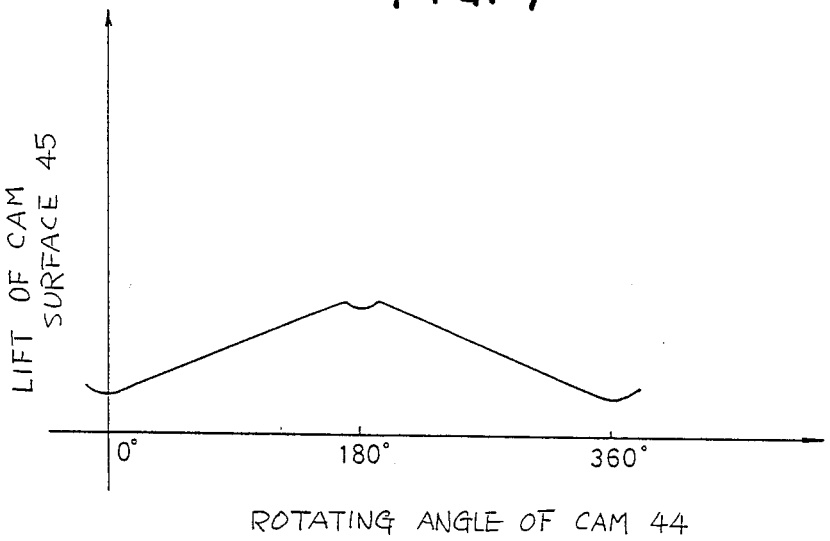
FIG. 7 is a graph illustrating a relation between the lift amount and the rotating angle of a cam.

As shown in FIG. 6, the second rotatable shaft 31 has a second one-way spring clutch 43 similar in construction to the first spring clutch 37. The second spring clutch 43 consists of a coil spring 40 wound on a relatively upper part of the shaft 31, and two coupling members in the form of sleeves 41, 42 which are loosely fitted on the shaft 31. This second spring clutch 43 is adapted to transmit rotation of the pulley 33 and the second rotatable shaft 31 to the coupling sleeves 41, 42 only when the rotation is in the direction "Bo" (opposite to the direction "B") as shown in FIG. 3. The upper coupling sleeve 41 of the second spring clutch 43 has a ratchet wheel **41*a* fitted thereon, while the lower coupling sleeve 42 has an end cam 44 fixed thereto in coaxial relation. The end cam 44 has a cam surface 45 on one of its opposite axial ends. As indicated in FIG. 6, the cam surface 45 is inclined relative to the axis of the second rotatable shaft 31, such that the two halves of the cam surface 45 are sloped downward in the direction from right to left in the figure. The cam surface 45 has two arcuate recesses 46, 47 at its lowest and highest portions. The cam surface 45 is profiled so that the cam 44 provides a relation between the lift amount (h) of the cam surface 45 and the rotation angle (degree) of the cam 44, as shown in FIG. 7**.

Figure 8:
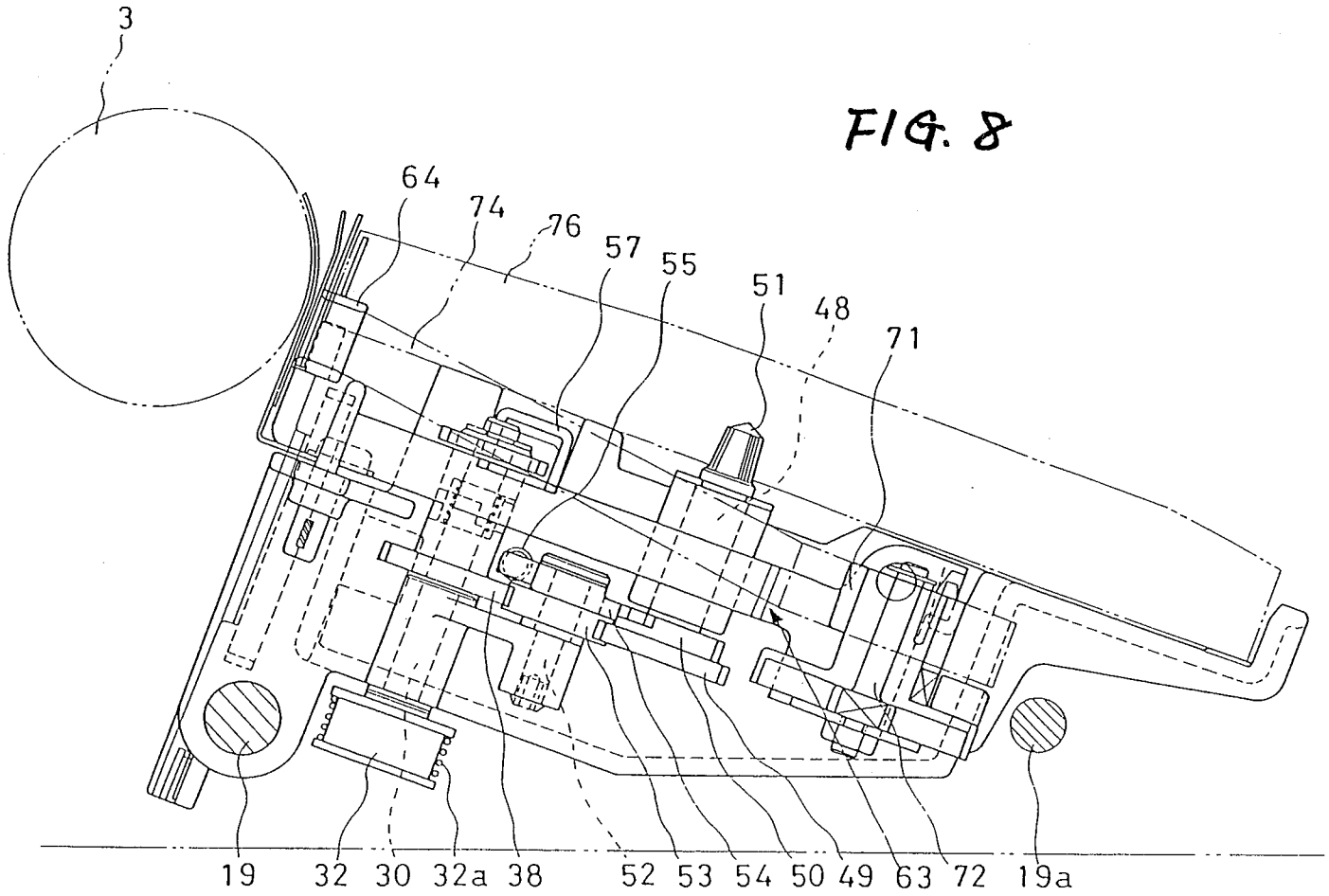
FIG. 8 is an enlarged right side view in elevation of the carriage assembly.

As shown in FIGS. 3 and 8, the carriage 17 further supports a drive shaft 48 adjacent to the first rotatable shaft 30. The drive shaft 48 has a spur gear 49 and a ratchet wheel 50 fixed to the lower end. The spur gear 49 is located in substantially the same plane as the spur gear 38 of the first rotatable shaft 30. The upper portion of the drive shaft 48 terminates in a sawtoothed head 51 which has sawteeth on its circumference.

Between the first rotatable shaft 30 and the drive shaft 48, there is provided a support shaft 52 with a pinion 53 which engages the spur gear 38 of the first rotatable shaft 30, and the spur gear 49 of the drive shaft 48. Further, the support shaft 52 supports a pawl 54 such that the pawl 54 is rotatable about the support shaft 52. The pawl 54 is biased by a coil spring 55 so that the pawl 54 is normally held in engagement with the ratchet wheel 50, thereby permitting the ratchet wheel 50 to rotate in a direction "C" as indiated in FIG. 3, but inhibiting the rotation of the ratchet wheel 50 in the opposite direction. The ratchet wheel 50 and the pawl 54 constitute a one-way ratchet **48*a* for preventing a take-up spool for the print ribbon 75, from being rotated in a direction that causes the ribbon 75 to become slack, due to a release torque of the first one-way spring clutch 37 when the carriage 17** is returned.

Referring back to FIGS. 2 and 3, a detent member in the form of a bar 56 is disposed movably in its longitudinal direction, between the first and second rotatable shafts 30, 31. The detent bar 56 is formed at its one end with a U-shaped first engaging portion 57 engageable with the ratchet wheel 39 on the first rotatable shaft 30, and at the other end with a second engaging portion 59 engageable with the ratchet wheel **41*a* on the second rotatable shaft 31. The bar 56 has a bent portion 58 at its intermediate portion. The bar 56 is longitudinally biased by a tension coil spring 60 in a direction "D" as indicated in FIGS. 2–4, so that the second engaging portion 59 is held in engagement with the ratchet wheel 41*a*, to inhibit the rotation of the wheel 41*a* even when the second rotatable shaft 31 is rotated in the direction Bo (FIG. 3) that causes the coil spring 40 to be tightly wound on the shaft 31. That is, the second engaging portion 59 prevents the coil spring 40 of the second spring clutch 43 from being tightly wound on the second rotatable shaft 31, thereby preventing transmission of a rotating movement of the second rotatable shaft 31 to the coupling sleeves 41, 42. Thus, the second one-way spring clutch 43 is disabled by means of the engagement of the second engaging portion 59 of the detent bar 56 with the ratchet wheel 41***a*.

The detent bar 56 is engageable at its bent portion 58 with an armature 62 of a solenoid 61 fixed to the carriage 17. This solenoid 61 cooperates with the detent bar 56 to constitute a rotation control mechanism 61*a* which will be described in detail. More specifically, the rotation control mechanism 61*a* includes an actuator in the form of the coil spring 60 and the solenoid 61, first disabling means in the form of the first engaging portion 57 of the bar 56, and second disabling means in the form of the second engaging portion 59 of the bar 56. When the solenoid 61 is energized, the armature 62 is moved in a direction "E" as indicated in FIGS. 2 and 3, thereby moving the detent bar 56 in the same direction against the biasing action of the spring 60, so as to keep the first engaging portion 57 in engagement with the ratchet wheel 39. In this condition, the second engaging portion 59 is disengaged from the corresponding ratchet wheel 41*a*. While the solenoid 61 is off, the second engaging portion 59 is in engagement with the ratchet wheel 41*a* under the biasing force of the spring 60, while the first engaging portion 57 is disengaged from the correspondong ratchet wheel 39.

Figure 9:
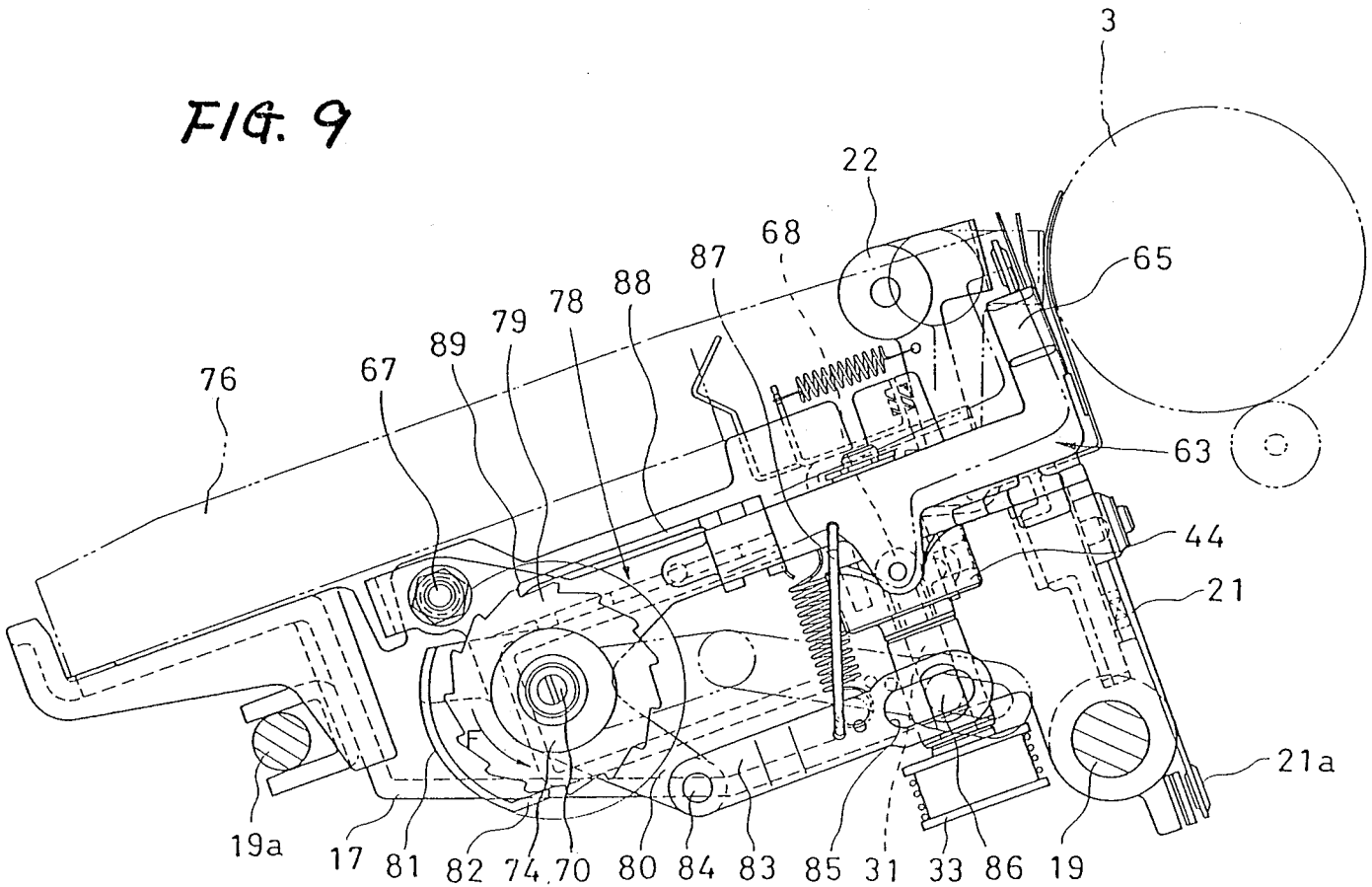
FIG. 9 is an enlarged left side view in elevation of the carriage assembly.

A generally U-shaped erase-ribbon lift member 63 is pivotally supported on the carriage 17. The lift member 63 has a pair of U-shaped ribbon guides 64, 65 formed at its ends. As most clearly shown in FIG. 2, the lift member 63 is supported pivotally about two support pins 66, 67 which are disposed remote from the ribbon guides 64, 65. As shown in FIG. 9, the lift member 63 is pivotable between its rest or inoperative position indicated in solid line in FIG. 9, and its erasing or operative position indicated in broken line in the same figure. In the rest position, the ribbon guides 64, 65 are positioned opposite to the circumferentially central part of the platen 3 as viewed in a direction parallel to the lift member 63. In the erasing position, the ribbon guides 64, 65 are positioned opposite to the upper half of the circumference of the platen 3 as viewed in the above direction. The lift member 63 is normally placed in its rest position, in which a roller 68 rotatably attached to the left arm of the lift member 63 is held in engagement with the arcuate recess 46 formed in the lowest part of the cam surface 45 of the end cam 44 on the second rotatable shaft 31.

As shown in FIG. 2, a bracket 69 and a support shaft 70 are supported horizontally in the vicinity of the pins 66, 67 of the lift member 63, respectively. A supply spool 72 for an erase ribbon 71 is rotatably supported on a shaft 73 fixed to the bracket 69, while a take-up spool 74 for the erase ribbon 71 is rotatably supported on the support shaft 70. The erase ribbon 71 supplied from the supply spool 72 is passed through the ribbon guides 64, 65 of the lift member 63, and wound on the take-up spool 74. The previously indicated print ribbon 75 is supplied from a ribbon cassette 76 removably mounted on the carriage 17, above the lift member 63. With the cassette 76 installed in position, the sawtoothed head 51 of the drive shaft 48 engages a toothed roller (not shown) for frictionally rotating a take-up spool 77 for the print ribbon 75, so that the rotating movement of the drive shaft 48 is transmitted to the take-up spool 77. The print ribbon 75 supplied from a supply spool (not shown) in the cassette 76 is passed between the platen 3 and the printing position of the type wheel 21, and wound on the take-up spool 77.

As depicted in FIGS. 2 and 9, a take-up mechanism 78 for rotating the take-up spool 74 for the erase ribbon 71 is disposed near the left arm of the erase-ribbon lift member 63. The take-up mechanism 78 includes a ratchet wheel 79 which is supported on the support shaft 70. The ratchet wheel 79 has a toothed portion 79*a* which the take-up spool 74 removably engages for rotation with the ratchet wheel 79. The ratchet wheel 79 is adapted to be rotatable only in a direction "F" (FIG. 9) on the support shaft 70, for winding the erase ribbon 71 on the take-up spool 74.

A pivot link 80 is pivotally supported on the support shaft 70 such that the link 80 is partially superposed on the ratchet wheel 79. The pivot link 80 is formed at its one end with an arucate extension 81 which is located radially outwardly of the ratchet wheel 79. The arcuate extension 81 has a pawl 82 which is held in engagement with the ratchet wheel 79, to permit the wheel 79 to rotate only in the direction "F". A connection link 83 is pivotally connected by a pin 84 at its one end to the other end of the pivot link 80 remote from the arcuate extension 81. The connection link 83 has an elongate hole 85 at the other end, which engages a boss 86 protruding horizontally from the carriage 17. A connecting rod 87 is pivotally connected at its one end to an intermediate portion of the connection link 83, and at its other end to an intermediate portion of the left arm of the lift member 63, near the roller 68, as indicated in FIG. 9. In this manner, the connecting rod 87 connects the connection link 83 and the lift member 63. A detent lever 88 is attached to a portion of the left arm of the lift member 63, between the support shaft 70 and the roller 68. The detent lever 88 has a pawl 89 at its one end. The pawl 89, which is similar to the pawl 82 of the arcuate extension 81, is held in engagement with the ratchet wheel 79. Thus, the detent lever 88 serves to prevent the rotation of the ratchet wheel 79 in a direction opposite to the direction "F".

The operation of the typewriter constructed as described above will now be described. For starting a printing operation, the carriage 17 is first positioned at a desired printing start position along a line of print. With the carriage 17 thus positioned, a desired character key on the keyboard 4 is operated. As a result, the stepping motor 20 is energized to rotate the type wheel 21 through the pinion 25 and the spur gear 26, by an appropriate angle necessary to bring the corresponding type font 21*a* into the printing position between the platen 3 and the hammer 22. The solenoid 23 is then energized to activate the armature 27, for operating the hammer 22 to impact the selected type font 21*a* against the paper 2 via the print ribbon 75. Subsequently, the stepping motor 5 is again activated to rotate the pulley 8*a* by a suitable amount through the pinion 8, whereby the carriage 17 is moved in the printing direction "A" (FIG. 2) by a one-character distance, by means of the wire wound on the pulley 8*a*. This movement of the carriage 17 causes the first and second rotatable shafts 30, 31 to be rotated in the direction "B" (FIGS. 3 and 4), by the string 32*a* wound on the pulleys 32, 33. Since the first engaging portion 57 of the detent bar 56 of the rotation control mechanism 61*a* is disengaged from the ratchet wheel 39 at this time, the rotation of the first rotatable shaft 30 is imparted to the coil spring 34 of the first one-way spring clutch 37, whereby the coil spring 3 is tightly wound on the rotatable shaft 30. As a result, the rotation of the first rotatable shaft 30 is transmitted to the lower coupling sleeve 35, and the spur gear 38 is rotated in the direction "B". This rotation of the spur gear 38 is imparted to the spur gear 49 on the drive shaft 48 via the pinion 53, whereby a torque is transmitted to the drive shaft 48 so as to rotate it in the direction "C" (FIG. 3). Since the pawl 54 engaging the ratchet wheel 50 permits the ratchet wheel 50 to rotate in the direction "C", by an angle corresponding to a ratchet wheel 50 are rotated together with the drive shaft 48 in the direction "C", by an angle corresponding to a pitch of the teeth of the spur gear 49. In this way, the drive shaft 48 is rotated, and the toothed roller engaging the saw-toothed head 51 of the drive shaft 48 is rotated to wind the corresponding length of the print ribbon 75 from the ribbon cassette 76, on the take-up spool 77. Thus, the active portion of the print ribbon 75 is fed a suitable distance past the printing position between the platen 3 and the type wheel 21.

Although the second rotatable shaft 31 is also rotated in the direction "B" through the pulley 33, the coil spring 40 of the second one-way spring clutch 43 will not be tightened on the second rotatable shaft 31, because the direction of winding of the coil spring 40 is so selected as to be tightened when the shaft 31 is rotated in the direction "Bo". Therefore, a torque of the second rotatable shaft 31 is not transmitted to the coupling sleeve 42, and the coupling sleeves 41, 42 remain stationary.

When a character key on the keyboard 4 is operated to print the next character, the corresponding type font 21*a* is selected into position, with the type wheel 21 rotated by a suitable angle by the stepping motor 20. Then, the solenoid 23 is energized to cause the hammer 22 to impact the selected type font 21*a* against the paper 2 via the print ribbon 75 which has been fed by the one-character distance. Thus, the corresponding character is printed next to the previously printed character. At the same time, the stepping motor 5 is operated to advance the carriage 17 in the printing direction A, via the pulley 8*a* and the wire wound thereon. The first and second rotatable shafts 30, 31 are again rotated in the direction "B", via the pulleys 32, 33 and the string 32*a* wound thereon. Now, the typewriter is ready for printing the next character. In this manner, desired words or lines of characters can be printed.

The printed character or characters may be corrected in the following manner.

Figure 10:
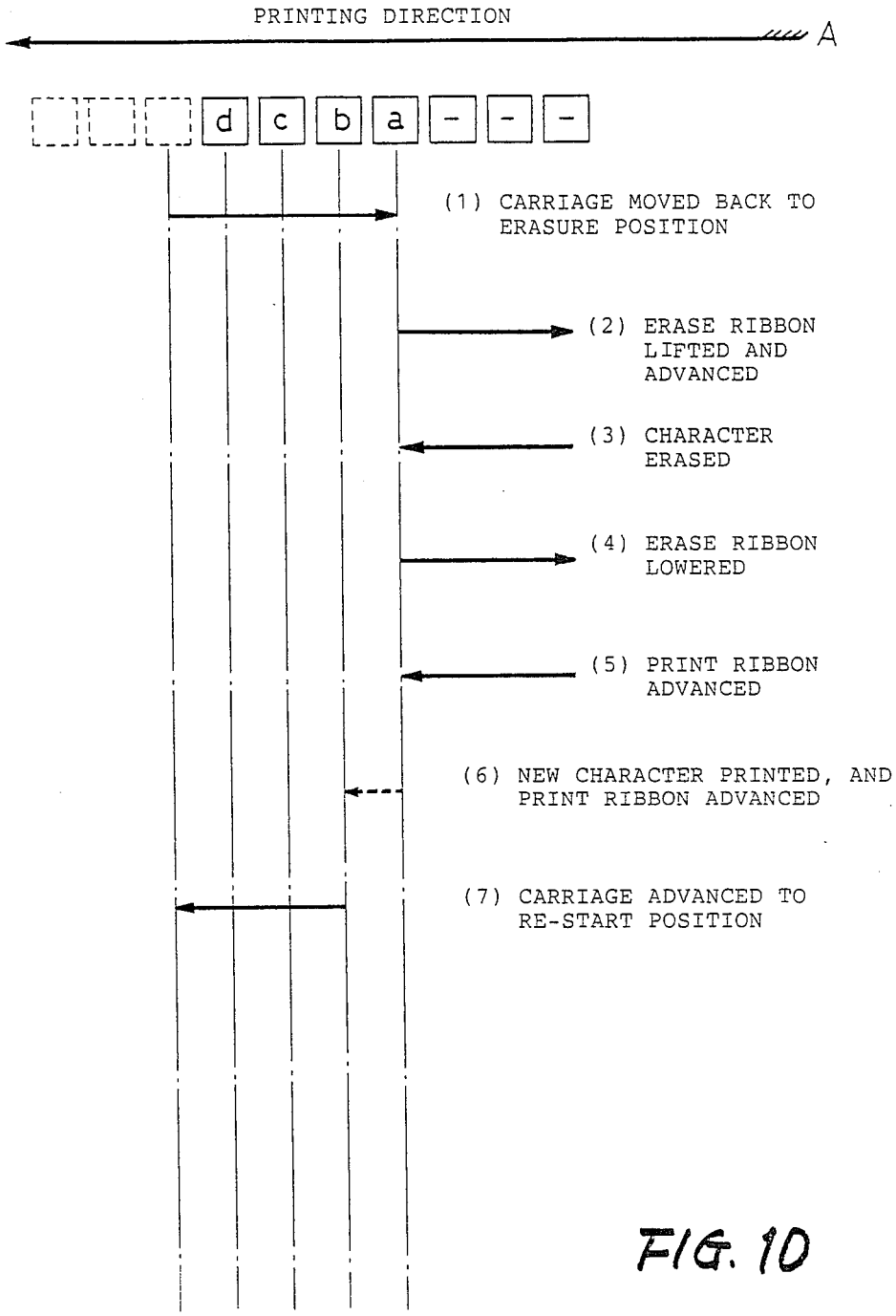
FIG. 10 is a diagrammatic view illustraing movements of the carriage for an erasing operation.

Referring to FIG. 10, there will be briefly described the movements of the carriage 17 to erase a previously printed character "a" and print a new correct character, after the last character "d" has been printed. Initially, the carriage 17 is moved back to the position of the character "a" to be erased, as indicated at (1) in FIG. 10. Then, the carriage 17 is further moved in the same direction (opposite to the printing direction "A"), by a suitable distance (corresponding to one or more characters), as indicated at (2). Then, the carriage 17 is moved in the printing direction "A", to the position of the character "a", as indicated at (3). After the character "a" is erased, the carriage 17 is again moved back to the same position as in (2), as indicated at (4). Then, the carriage 17 is returned to the position of the erased character "a", as indicated at (5). At this time, a new character is printed, and the carriage 17 is advanced to the next character position (position of the next character "b"), as indicated at (6). Finally, the carriage 17 is advanced to a re-start position ahead of the last printed character "d", as indicated at (7).

The correcting operation briefed above will be described in greater detail. If the operator finds, after the printing of the last character "d", that the character "a" was printed by error and should be replaced by a correct character, a backspace key on the keyboard 4 is operated a suitable number of times, to move the carriage 17 to the position of the character "a", as indicated at (1) in FIG. 10. As a result, the stepping motor 5 is activated to rotate the pulley 8*a* via the pinion 8, in the direction opposite to that for the normal printing operation. The movement (1) of the carriage 17 is thus effected, with the wire (not shown) connected to the carriage 17 being wound on the rotating pulley 8*a*. At the same time, the first and second pulleys 32, 33 are rotated in the direction opposite to the direction "B". While the rotation of the first pulley 32 is transmitted to the first rotatable shaft 30, the coil spring 34 will not be tightly wound on the shaft 30, whereby only the first rotatable shaft 30 is rotated, with the coupling sleeves 35, 36 remaining standstill. On the other hand, the rotation of the second pulley 33 is transmitted to the second rotatable shaft 31. However, since the second engaging portion 59 of the detent bar 56 is now in engagement with the ratchet wheel 41*a*, an angular displacement of the upper coupling sleeve 41 is inhibited, whereby the coil spring 40 will not be tightened on the second rotatable shaft 31. Thus, the second one-way spring clutch 43 is disabled, and the coupling sleeves 41, 42 remain standstill, with only the second rotatable shaft 31 being rotated in the direction "Bo". In this manner, the return movement (1) of the carriage 17 to the position of the character "a" is achieved by operating the backspace key until the hammer 22 is aligned with the printed character "a".

Then, the operator operates a "correction key" (not shown) on the keyboard 4. Consequently, a series of correcting operations including the above-indicted movements (2) through (5) of the carriage 17 are effected, with the stepping motor 5 and the solenoid 61 of the rotation control mechanism 61*a* being operated under the control of a suitable control unit (not shown). More specifically, upon activation of the correction key, the solenoid 61 is energized, and the armature 62 is moved in the direction "E", whereby the detent bar 56 is moved by the armature 62 in the direction opposite to the direction "D", against the biasing force of the coil spring 60. As a result, the second engaging portion 59 of the detent bar 56 is disengaged from the ratchet wheel 41*a* on the second rotatable shaft 31, while the first engaging portion 57 is brought into engagement with the ratchet wheel 39 on the first rotatable shaft 30, to inhibit the rotation of the ratchet wheel 39 in the direction "B". In this condition, the stepping motor 5 is energized to effect the movement (2) of the carriage 17 in the direction opposite to the printing direction "A", with the pulley 8*a* rotated in the appropriate direction. Consequently, the first and second rotatable shafts 30, 31 are rotated in the direction opposite to the direction "B", by means of the pulleys 32, 33 and the string 32*a* wound thereon. Since the coil spring 34 will not be tightened on the first rotatable shaft 30, the coupling sleeves 35, 36 remain stationary while the shaft 30 is rotating. On the other hand, the rotation of the second rotatable shaft 31 in the direction "Bo" will cause the coil spring 40 to be defomed so as to be tightly wound on the shaft 31. Since the ratchet wheel 41*a* is freed from the second engaging portion 59 of the detent bar 56, the rotation of the second rotatable shaft 31 is transmitted to the coil spring 40 and to the coupling sleeves 41, 42, whereby the end cam 44 is rotated in the direction "Bo" by 180 degrees. The rotating movement of the cam 44, which has the characteristic curve as shown in FIG. 7, will cause the roller 68 of the erase-ribbon lift member 63 to roll on the cam surface 45, from the lower arcuate recess 46 up to the upper arcuate recess 47. The roller 68 is then kept in engagement with the upper arcuate recess 47 in the cam surface 44. With this upward rolling movement of the roller 68, the lift member 63 is pivoted about the pins 66, 67, from the rest position indicted in solid line in FIG. 9, up to the erasing position indicated in broken line in the same figure. As a result, the active portion of the erase ribbon 71 is lifted to its erasing position aligned with the printing position on the platen 3.

Then, the stepping motor 5 is energized again to effect the movement (3) of the carriage 17 in the printing direction, to the position of the character "a" to be erased. Since the solenoid 61 is kept energized, and the rotation of the ratchet wheel 39 is prevented by the first engaging portion 57, the rotation of the first rotatable shaft 30 in the direction "B" will not cause the coil spring 34 to be tightly wound on the shaft 30, whereby the print ribbon 75 is not fed. Similarly, the rotation of the second rotatable shaft 31 in the direction "B" will not cause the second spring clutch 43 to rotate the end cam 44, whereby the lift member 63 and the erase ribbon 71 are kept in their lifted or erasing position. After the movement (3) of the carriage 17 is completed, a character key corresponding to the character "a" is operated, and the stepping motor 20 is operated to index the type wheel 21 via the pinion 25 and the spur gear 26, for bringing the corresponding type font 21*a* into the printing position alinged with the printed character "a" on the paper 2. Then, the solenoid 23 is energized, and the hammer 22 is operated by the armature 27, whereby the type font 21*a* is impacted by the hammer 22, against the printed character "a" on the paper 2, via the erase ribbon 71 (and the print ribbon 75). Thus, the printed character "a" is erased by the erase ribbon 71, and the corresponding area on the paper 3 is blanked.

Subsequently, the movement (4) of the carriage 17 in the direction opposite to the printing direction "A" is effected while the solenoid 61 is kept energized, i.e., while the ratchet wheel 41*a* is kept free. As a result, the end cam 44 is rotated in the direction "Bo" by a half turn, whereby the roller 68 of the lift member 63 rolls down on the cam surface 45, from the upper arcuate recess 47 down to the lower arcuate recess 46. Therefore, the lift member 63 and the erase ribbon 71 are lowered or restored to their rest or inoperative position.

Then, the movement (5) of the carriage 17 in the printing direction "A" to the position of the erased character "a" is accomplished. The solenoid 61 is deenergized before the carriage 17 reaches the position of the erased character "a", more precisely, when the carriage 17 reaches a point behind the position of the erased character "a" by a distance corresonding to one or two characters. In consequence, the armature 62 is moved in the direction "D", allowing the detent bar 56 to be moved in the same direction "D" until the second engaging portion 59 comes into engagement with the ratchet wheel 41*a*. In other words, the ratchet wheel 39 on the first rotatable shaft 30 is freed from the first engaging portion 57 of the detent bar 56. In this condition, the carriage 17 is moved by the remaining distance to the position of the erased character "a". During this movement, the drive shaft 48 is rotated by the rotation of the spur gear 38 with the first rotatable shaft 30 in the direction "B". Thus, the print ribbon 75 is fed by a distance corresponding to one or two characters, whereby the portion of the print ribbon 75 used during the erasure of the charater "a" is replaced by a new fresh portion of the ribbon 75.

The new correct character is then printed on the erased portion of the paper 2, by operating the appropriate character key on the keyboard 4. The carriage 17 is then advanced by one-character distance, as indicated at (6) in FIG. 10, and the hammer 22 is aligned with the printed character "b".

When it is desired to erase also the character "b", the correction key is again operated without operating any character key, to execute the above-mentioned series of correcting operations. A correct character is printed after the movement (6) of the carriage 17. Thus, any desired number of successive characters may be corrected by operating the correction key the appropriate number of times.

After all desired correcting operations have been complete, a relocation key or space key (not shown) on the keyboard 4 is operated, to return the carriage 17 to a position one character ahead of the last printed character "d", i.e., to a re-start position at which the normal printing operation is resumed. This movement of the carriage 17 is indicated at (7) in FIG. 10.

Then, the feeding operation of the erase ribbon 71 will be described.

When the lift member 63 is lifted from its rest position to its erasing position during the movement (2) of the carriage 17, the connecting rob 87 is pulled up by the lift member 63 substantially in its longitudinal direction. As a result, the connection link 83 of the take-up mechanism 87 is pivoted about the boss 86 from the position indicated in solid line in FIG. 9, to the position indicated in broken line in the figure. Therefore, the pivot link 80 is pivoted about the support shaft 70 in the direction "F", whereby the ratchet 79 is rotated in the direction "F" by the pawl 82 at the end of the arcuate extension 81 of the pivot link 80. This rotation of the ratchet wheel 79 is transmitted to the take-up spool 74 through the toothed portion 79*a* of the ratchet wheel 79, whereby the take-up spool 74 is rotated in the direction "F", and the erase ribbon 71 is fed from the supply spool 72 to the take-up spool 74 by a distance which corresponds to the printing pitch (one-character distance).

When the lift member 63 is lowered from its erasing position to its rest position during the movement (4) of the carriage 17, the connection link 83 is moved from the broken-line position of FIG. 9 down to the solid-line position of the same figure by the connecting rod 87. Since the rotation of the ratchet wheel 79 in the direction opposite to the direction "F" is inhibited by the pawl 89, the pivotal movement of the pivot link 80 as a result of the movement of the connection link 83 will merely cause the pawl 82 of its arcuate extension 81 to slide on the corresponding tooth of the ratchet wheel 79. Therefore, the ratchet wheel 79 is not rotated, and the erase ribbon 71 is not fed by or wound on the take-up spool 74.

In the instant typewriter which has been described above, the first and second rotatable shafts 30, 31 rotatably supported on the carriage 17 are rotated when the carriage 17 is reciprocated. In the normal printing mode, the rotating movement of the first rotatable shaft 30 is transmitted to the take-up spool 77 of the ribbon cassette 76 for the print ribbon 75. In the correction mode which is established by the correction key, the rotation of the second rotatable shaft 31 in the direction "Bo" as a result of the movement (2) of the carriage 17 is transmitted to the end cam 44 while the ratchet wheel 41*a* is kept free from the detent bar 56 with the solenoid 61 energized. Accordingly, the left member 63 is pivoted from its rest position to its erasing position. Hence, the instant typewriter does not require drive motors or transmission mechanism such as gear trains, for operating the take-up spool 77 of the print ribbon 75, and the erase-ribbon lift member 63. This means various advantageous effects, i.e., reduced cost of the typewriter, and reduced size and weight of the carriage assembly, which indicates a reduced inertia of the carriage assembly. This results in reduced load applied to the stepping motor 5 for driving the carriage assembly, and improved response of the carriage to the operations of the character keys on the keyboard 4, leading to improved printing efficiency and enhanced printing accuracy.

In the illustrated embodiment, the solenoid 61 may be advantageously energized to prevent rotation of the ratchet wheel 39, when the carriage 17 is moved in the printing direction "A" without printing, as a result of operation of the space key or tab key. In this case, the take-up spool 77 will not be rotated, thereby avoiding a waste of the print ribbon 75.

Although the rotation control mechanism 61*a* includes the armature 62 movable by the solenoid 61, this armature 62 may be eliminated. In this instance, the solenoid 61 is adapted to move the detent bar 56 in the direction "E", by directly attracting the detent bar 56 at a suitable portion. Further, the carriage drive mechanism including the pulley 8*a* and the wire which is wound on the pulley 8*a* and connected to the carriage 17, may be modified as desired. For example, the carriage drive mechanism may use a rack and a pinion, or a pulley and a belt.

While the illustrated embodiment does not have a memory for storing the printed characters, it is possible to provide the typewriter with such a memory, so that the printed character on the recording medium may be erased by simply pressing the correction key, without having to operate the corresponding character key.

Further, it is possible to modify the typewriter such that a second spring clutch transmits the rotation of the second rotatable shaft 31 only in the direction "B", but the second spring clutch is disabled by the detent bar 56 engaging the ratchet wheel 41*a* while the carriage 17 is moved in the printing direction "A". In this case, when the stepping motor 5 is energized to move the carriage 17 in the printing direction "A", in the correction mode, the solenoid 61 is energized to move the detent bar 56 in the direction "E", for disengaging the detent bar 56 from the ratchet wheel 41*a* on the second rotatable shaft 31, and for engaging the detent bar 56 with the ratchet wheel 39 on the first rotatable shaft 30. In this condition, the carriage 17 is moved in the printing direction "A" to rotate the end cam 44 on the second rotatable shaft 31.

Figure 11:
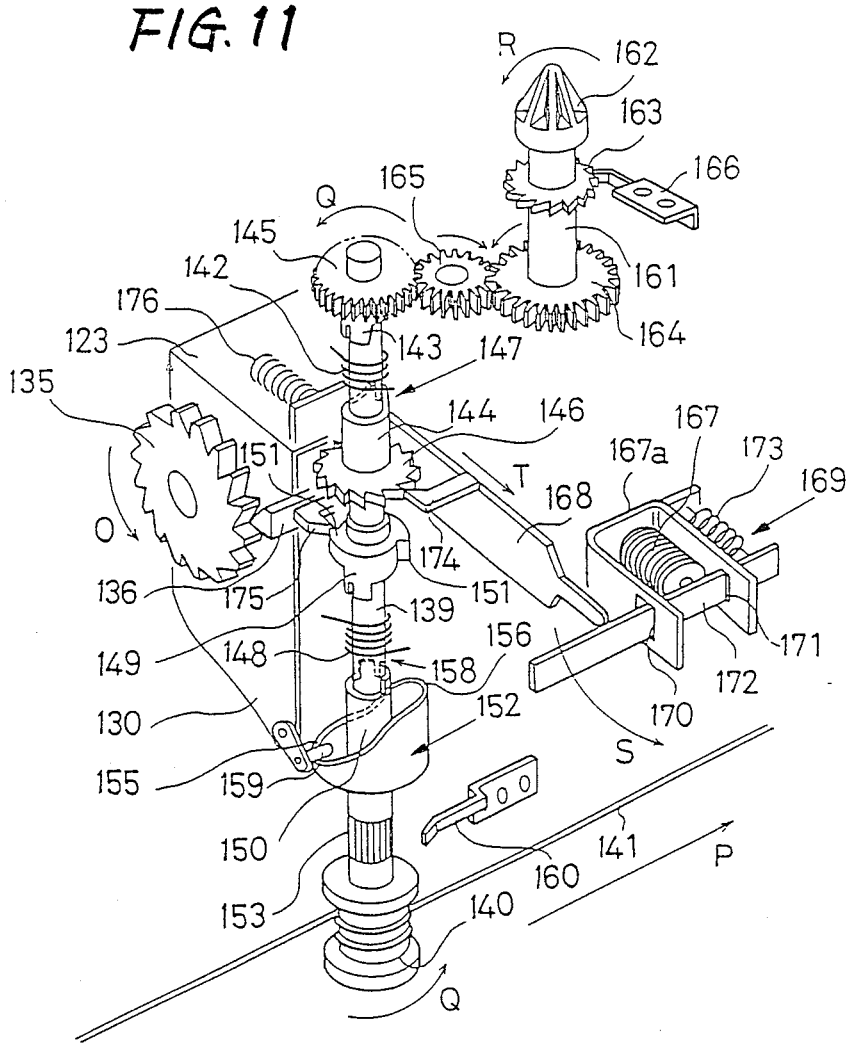
FIG. 11 is a perspective view of a part of another embodiment of the invention.

Another embodiment of the present invention is illustrated in FIG. 11, in which a single rotatable shaft 139 is used in place of the two rotatable shafts 30, 31 used in the preceding embodiment. The present modified embodiment is different from the preceding embodiment in some other aspects as described below.

Reference numeral 123 designates a holder which is supported on a carriage, and which carries a ribbon cassette for a print ribbon, and a supply spool and a take-up spool for an erase ribbon. The carriage, the ribbon cassette and the supply and take-up spools are similar to those used in the preceding embodiment, and are not shown in FIG. 11. The holder 123 is adapted to be vertically movable relative to the carriage, between its lower and upper positions, to selectively locate the active portion of the print and erase ribbons at their printing or erasing position.

A ratchet wheel 135 which is integral with the take-up spool for the erase ribbon is rotatably supported on a support plate 130 which extends downward from one end of the holder 123. The ratchet wheel 135 is engageable with an actuator lever 136 which extends from the carriage. The rotatable shaft 139 indicated above is rotatably supported by the carriage, and adapted to be rotated in a direction "Q" by means of a pulley 140 and a wire 141, when the carriage is moved in a printing direction "P". The principle to rotate the shaft 139 by the pulley 140 and the wire 141 wound thereon is the same as described in connection with the preceding embodiment. The rotatable shaft 139 is provided with two-way spring clutches generally indicated at 147, 158. More specifically, the first spring clutch 147 includes a coil spring 142 wound in the upper part of the shaft 139, and a pair of coupling sleeves 143, 144. A spur gear 145 and a ratchet wheel 146 are secured to the coupling sleeves 143, 144, respectively. When first spring clutch 147 serves to transmit the rotation of the rotatable shaft 139 to the spur gear 145 and the ratchet wheel 146 when the rotation takes place in the direction "Q".

The second spring clutch 158 includes a coil spring 148, and a pair of coupling sleeves 149, 150. The upper coupling sleeve 149 has two integrally formed teeth 151. On the other hand, the lower coupling sleeve 140 is formed with an end cam 152 and a ratchet portion 153. The end cam 152 has a cam surface 154 similar to the cam surface 45 of the end cam 44 used in the preceding embodiment. The cam surface 154 has a lowermost portion 155 corresponding to the lower position of the holder 123 (printing position of the print ribbon), and a uppermost portion 156 corresponding to the upper position of the holder 123 (erasing position of the erase ribbon).

A cam follower 149 is secured to the lower end of the support plate 130. Normally, the cam follower 159 is held in contact with the lowermost portion 155 of the cam surface 154, so that the active portion of the print ribbon is located at its printing position. A pawl 160 is provided to inhibit the rotation of the lower coupling sleeve 150 in the direction "Q".

The carriage also supports a drive shaft 161 for the take-up spool for the print ribbon. The drive shaft 161 has a toothed head at its upper end, for rotating the take-up spool for the print ribbon. A ratchet wheel 163 is fixed to an intermediate portion of the drive shaft 161, and a spur gear 164 is fixed to the lower end of the shaft 161. The spur gear 164 is connected to the spur gear 145 on the rotatable shaft 139, via an intermediate gear 165. A pawl 166 is held in engagement with the ratchet wheel 163, to inhibit the rotation of the wheel 163 in a direction opposite to a direction "R". Namely, the pawl 166 is provided to permit the ratchet wheel 163 to rotate only in the direction "R".

The instant modified embodiment using the single rotatable shaft 139 employs a rotation control mechanism 169 supported on the carriage. The control mechanism 169 includes a solenoid 167 and a shuttle plate 168. The solenoid 167 is held by a generally U-shaped yoke 167*a* which has two rectangular apertures 170, 171 formed in the opposite arm portions. A lever 172 extends through these apertures 170, 171 such that the lever 172 is substantially perpendicular to the axis of the rotatable shaft 139. The aperture 170 has a width larger than that of the other aperture 171, so that the lever 172 may be pivoted about aperture 171. The lever 172 is biased by a coil spring 173 in a direction "S".

The shuttle plate 168 is supported so that it is movable in its longitudinal direction perpendicular to the rotatable shaft 139. The shuttle plate 168 is biased by a compression coil spring 176 in a direction "T", so that one of the opposite ends of the plate 168 is held in abutting contact with the lever 172. The shuttle plate 168 has two pawls 174, 175 extending horizontally from its intermediate portion in the same direction perpendicular to the longitudinal direction. The two pawls 174, 175 are spaced from each other in the longitudinal direction of the shuttle plate 168, and are vertically aligned respectively with the ratchet wheel 146 and the teeth 151 on the upper coupling sleeve 149 of the second spring clutch 158. Normally, the pawl 174 is disengaged from the ratchet wheel 146, while the pawl 174 is held in engagement with one of the two teeth 151. Accordingly, the lower coupling sleeve 144 of the first spring clutch 147 is free to rotate, while the upper coupling sleeve 149 of the second spring clutch 158 is prevented from rotating in the direction opposite to the direction "Q".

Figure 12:
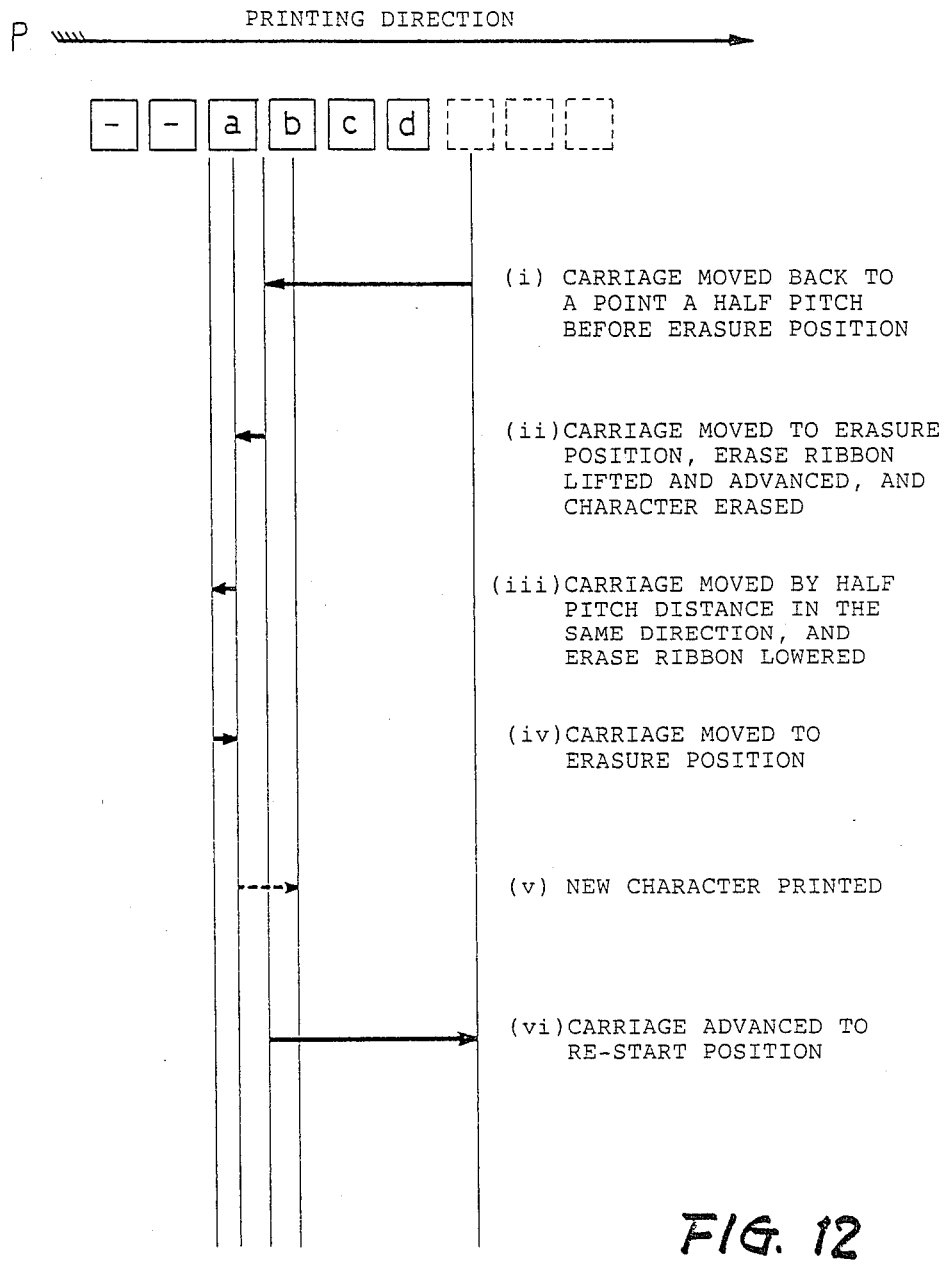
FIG. 12 is a diagrammatic illustration showing movements of the carriage of the embodiment of FIG. 11 for an erasing operation.

FIG. 12 shows movements of the carriage when a correction printing operation is performed in this modified embodiment of FIG. 11. The situation of the correcting operation is similar to that of FIG. 10 in the preceding embodiment.

Initially, a backspace key is operated to move the carriage in a direction opposite to the printing direction "P". The backspace key is kept operated until the carriage has reached a point which is a half pitch before the erasure position, i.e., the position of the printed character "a", as indicated at (i) in FIG. 12. The rotation of the rotatable shaft 139 as a result of the carriage movement (i) will not cause the coil springs 142, 148 to be tightened on the shaft 139, whereby the spur gear 145 and the end cam 152 are not rotated.

After the carriage has been moved to the above-indicated point near the position of the character "a" to be erased, a correction key is operated, and the solenoid 167 and a carriage drive stepping motor similar to the motor (5) are energized. As a result, the lever 172 is pivoted in a direction opposite to the direction "S", against the biasing force of the tension coil spring 173, to move the shuttle plate 168 against the biasing force of the compression coil spring 176. Consequently, the pawl 175 is disengaged from the tooth 151 on the coupling sleeve 149, while the pawl 174 is brought into engagement with the ratchet wheel 146.

Then, the carriage is further moved by a half-pitch distance, to the position of the character "a", as indicated at (ii) in FIG. 12. As a result, the rotatable shaft 139 is rotated in the direction opposite to the direction "Q". This rotation will not cause the coil spring 142 of the first spring clutch 147 to be tightened on the shaft 1. Therefore, the drive shaft 161 for feeding the print ribbon will not be rotated. On the other hand, the rotation of the shaft 139 will cause the coil spring 148 of the second spring clutch 158 to be tightly wound on the shaft 1, whereby the coupling sleeves 149, 150 and the end cam 152 are rotated by a half turn in the direction opposite to the direction "Q". Consequently, the follower 159 is pushed up by the cam surface 154, from the lowermost portion 155 up to the uppermost portion 156. Thus, the holder 123 is lifted to its upper position in which the active portion of the erase ribbon is located at its erasing position. Further, the lifting movement of the holder 123 will cause the ratchet wheel 135 to be rotated by the actuator lever 136, by an angle corresponding to the tooth pitch. Accordingly, the erase ribbon is advanced by a predetermined distance. Then, the character key corresponding to the character "a" is operated, to erase the character "a", in the same manner as described in connection with the preceding embodiment.

Subsequently, the carriage is further moved by the half-pitch distance in the same direction, as indicated by (iii) in the figure, while the solenoid 167 is kept energized. Accordingly, the end cam 152 is further rotated by a half turn, whereby the cam follower 159 is lowered to its lower position, and the holder 123 is lowered to its lower position. Thus, the erase ribbon is lowered. Although the ratchet wheel 135 is lowered with the holder 123, the wheel 135 will not be rotated by the actuator lever 136, since the lever 136 merely slides on the appropriate tooth on the wheel 135. Therefore, the erase ribbon will not be fed.

Then, the carriage is moved in the printing direction "P" to the position of the erased character "a". As a result, the shaft 139 is rotated in the direction "Q". Since the ratchet wheel 146 engages the pawl 174, the coil spring 142 will not be tightened on the shaft 131, and the spur gear 145 will not be rotated. Similarly, the rotation of the shaft 139 in the direction "Q" will not be transmitted by the spring clutch 158, since the lower coupling sleeve 150 is prevented from rotating in the direction "Q", by the engagement of the ratchet portion 153 with the pawl 160. Upon completion of the carriage movment (iv), a character key corresponding to a desired new character is operated to print the new character on the erased area of the paper. At this time, the solenoid 167 is deenergized, and the shuttle bar 168 is restored to its original position. The carriage is automatically advanced to the next character position, as indicated at (v). The next character "b" may be erased, and a new character may be printed, in the same manner as described above. After all desired correcting operations are completed, the carriage is advanced to the re-start position one character ahead of the last character "d" in the printing direction, as indicated at (vi).

According to the present modified embodiment using the single rotatable shaft 139, the carriage assembly can be further simplified in construction, with reduced number of parts. This means further reduction in the cost of the parts and the cost of assembling, and further reduction in the size and weight of the carriage assembly, as compared with the preceding embodiment.

While the present invention has been described in its preferred embodiments, it is to be understood that the invention is not limited to the details of the illustrated embodiments, but may be embodied with various modifications and improvements other than those previously indicated, which may occur to those skilled in the art within the scope of the invention defined in the appended claims.

What is claimed is:

1. A printing apparatus, comprising:

a platen for supporting a recording medium;

a carriage reciprocable in a longitudinal direction of the platen;

a carriage drive device for reciprocating the carriage;

a first and a second ribbon feed mechanism supported by the carriage, for feeding a print ribbon and an erase ribbon at a predetermined pitch, respectively;

a print/erase head supported by the carriage, for printing a character on the recording medium via the print ribbon, and erasing a character on the medium via the erase ribbon;

a first and a second rotatable shaft supported by the carriage rotatably in opposite directions when the carriage is moved in corresponding opposite directions;

a first one-way clutch for transmitting a rotating movement of the first rotatable shaft in one of said opposite directions, to the first ribbon feed mechanism, and inhibiting transmission of a rotating movement of the first rotatable shaft in the other direction to the first ribbon feed mechanism;

an erase-ribbon lift member for shifting an active portion of the erase ribbon between an erasing position in which said active portion is located between said print/erase head and the recording medium, and an inoperative position in which said active portion is located away from said erasing position;

a converter mechanism for converting a rotating movement of the second rotatable shaft into shifting movements of the erase-ribbon lift member to shift the active portion of the erase ribbon; and a rotation control mechanism for inhibiting transmission of the rotating movement of the second rotatable shaft to said converter mechanism when the apparatus is in a normal printing mode, and transmitting the rotating movement of the second rotatable shaft to the converter mechanism when the apparatus is in a correction mode, whereby reciprocating movements of the carriage cause said shifting movements of said erase-ribbon lift member, and a feeding movement of said first ribbon feed mechanism to advance the print ribbon without said shifting movements of said erase-ribbon lift member.

2. The printing apparatus of claim 1, wherein said rotation control mechanism comprises a second one-way clutch for transmitting the rotating movement of the second rotatable shaft in one of said opposite directions, to said converter mechanism, and inhibiting transmission of the rotating movement of the second rotatable shaft in the other direction, said rotation control mechanism further comprising second disabling means for inhibiting the transmission of the rotating movement of the second rotatable shaft in said one direction when the apparatus is in said normal printing mode.

3. The printing apparatus of claim 2, wherein said second one-way clutch includes:

a first coupling member engaging the second rotatable shaft rotatably relative to each other, and connected to said converter mechanism;

a second coupling member engaging the second rotatable shaft rotatably relative to each other; and a spring wound on the second rotatable shaft so as to hold the second rotatable shaft, and having opposite ends which engage the first and second coupling members, respectively, and wherein said second disabling means includes:

a detent member engageable with the second coupling member for inhibiting rotation of the second coupling member; and an actuator for moving the detent member between an engaging position in which the detent member engages the second coupling member, and a release position in which the detent member is disengaged from the second coupling member.

4. The printing apparatus of claim 2, further comprising a first disabling means for preventing said first one-way clutch from transmitting the rotating movement of said first rotatable shaft in said one direction to said first ribbon feed mechanism.

5. The printing apparatus of claim 4, wherein said first and second disabling means are selectively actuated by a common actuator.

6. The printing apparatus of claim 1, further comprising a linkage for transmitting said shifting movements of said erase-ribbon lift member to said second ribbon feed mechanism to feed said erase ribbon, whereby said reciprocating movements of the carriage cause a feeding movement of said second ribbon feed mechanism, as well as said feeding movement of said first ribbon feed mechanism and said shifting movements of said erase-ribbon lift member.

7. The printing apparatus of claim 6, wherein said linkage includes another one-way clutch for transmitting one of an elevating and a lowering movement of said erase-ribbon lift member to said second ribbon feed mechanism, and inhibiting transmission of the other of said elevating and lowering movements to said second ribbon feed mechanism.

8. A printing apparatus, comprising:

a platen for supporting a recording medium;

a carriage reciprocable in a longitudinal direction of the platen;

a carriage drive device for reciprocating the carriage;

a first and a second ribbon feed mechanism supported by the carriage, for feeding a print ribbon and an erase ribbon at a predetermined pitch, respectively;

a print/erase head supported by the carriage, for printing a character on the recording medium via the print ribbon, and erasing a character on the medium via the erase ribbon;

a first and a second rotatable shaft supported by the carriage rotatably in opposite directions when the carriage is moved in corresponding opposite directions;

a first one-way clutch for transmitting a rotating movement of the first rotatable shaft in one of said opposite directions, to the first ribbon feed mechanism, and inhibiting transmission of a rotating movement of the first rotatable shaft in the other direction to the first ribbon feed mechanism; and a rotation control mechanism for inhibiting transmission of the rotating movement of the second rotatable shaft to said second ribbon feed mechanism when the apparatus is in a normal printing mode, and transmitting the rotating movement of the second rotatable shaft to the second ribbon feed mechanism when the appratus is in a correction mode, whereby reciprocating movements of the carriage cause a feeding movement of said second ribbon feed mechanism to advance the erase ribbon, and a feeding movement of said first ribbon feed mechanism to advance the print ribbon with said feeding movement of said second ribbon feed mechansim.

9. A printing apparatus, comprising:

a platen for supporting a recording medium;

a carriage reciprocable in a longitudinal direction of the platen;

a carriage drive device for reciprocating the carriage;

a first and a second ribbon feed mechanism supported by the carriage, for feeding a print ribbon and an erase ribbon at a predetermined pitch, respectively;

a print/erase head supported by the carriage, for printing a character on the recording medium via the print ribbon, and erasing a character on the medium via the erase ribbon;

a rotatable shaft supported by the carriage rotatably in opposite directions when the carriage is moved in corresponding opposite directions;

a one-way clutch for transmitting a rotating movement of the rotatable shaft in one of said opposite directions, to the first ribbon feed mechanism, and inhibiting transmission of a rotating movement of the rotatable shaft in the other direction to the first ribbon feed mechanism;

an erase-ribbon lift member for shifting an active portion of the erase ribbon between an erasing position in which said active portion is located between swaid print/erase head and the recording medium, and an inoperative position in which said active portion is located away from said erasing position;

a converter mechanism for converting a rotating movement of the rotatable shaft into shifting movements of the erase-ribbon lift member to shift the active portion of the erase ribbon; and a rotation control mechanism for inhibiting transmission of the rotating movement of the rotatable shaft to said converter mechanism when the apparatus is in a normal printing mode, and transmitting the rotating movement of the rotatable shaft to the converter mechanism when the apparatus is in a correction mode, whereby reciprocating movements of the carriage cause said shifting movements of said erase-ribbon lift member, and a feeding movement of said first ribbon feed mechanism to advance the print ribbon without said shifting movements of said erase-ribbon lift member.

10. The printing apparatus of claim 9, further comprising a linkage for transmitting said shifting movements of said erase-ribbon lift member to said second ribbon feed mechanism to feed said erase ribbon, whereby said reciprocating movements of the carriage cause a feeding movement of said second ribbon feed mechanism, as well as said feeding movement of said first ribbon feed mechanism and said shifting movements of said erase-ribbon lift member.

11. A printing apparatus, comprising:

a platen for supporting a recording medium;

a carriage reciprocable in a longitudinal direction of the platen;

a carriage drive device for reciprocating the carriage;

a first and a second ribbon feed mechanism supported by the carriage, for feeding a print ribbon and an erase ribbon at a predetermined pitch, respectively;

a print/erase head supported by the carriage, for printing a character on the recording medium via the print ribbon, and erasing a character on the medium via the erase ribbon;

a rotatable shaft supported by the carriage rotatably in opposite directions when the carriage is moved in corresponding opposite directions;

a one-way clutch for transmitting a rotating movement of the rotatable shaft in one of said opposite directions, to the first ribbon feed mechanism, and inhibiting transmission of a rotating movement of the rotatable shaft in the other direction to the first ribbon feed mechanism; and a rotation control mechanism for inhibiting transmission of the rotating movement of the rotatable shaft to said second ribbon feed mechanism when the apparatus is in a normal printing mode, and transmitting the rotating movement of the rotatable shaft to the second ribbon mechanism when the apparatus is in a correction mode, whereby reciprocating movements of the carriage cause a feeding movement of said second ribbon feed mechanism to advance the erase ribbon, and a feeding movement of said first ribbon feed mechanism to advance the print ribbon without the feeding movement of the second ribbon feed mechanism.

* * * * *